US005087267A

United States Patent [19]

Nasu

[11] Patent Number: 5,087,267

[45] Date of Patent: Feb. 11, 1992

[54] FUEL ADDITIVES

[76] Inventor: Atsushi Nasu, 99 Katako, Youkaichiba-shi, Chiba-ken, Japan

[21] Appl. No.: 498,222

[22] Filed: Mar. 23, 1990

[30] Foreign Application Priority Data

Apr. 4, 1989 [JP] Japan ..... 1-85249
May 2, 1989 [JP] Japan ..... 1-113246

[51] Int. Cl.[5] ..... C10L 1/00
[52] U.S. Cl. ..... 44/302
[58] Field of Search ..... 44/53, 50, 51, 302

[56] References Cited

U.S. PATENT DOCUMENTS 58,180 9/1866 Scott ..... 44/50
110,054 12/1870 Lupton ..... 44/50
3,948,617 4/1976 Withorn ..... 44/50
4,852,992 8/1989 Nasu ..... 44/50

FOREIGN PATENT DOCUMENTS 63-0225695 9/1988 Japan .

*Primary Examiner*—Margaret Medley
*Attorney, Agent, or Firm*—Lorusso & Loud

[57] ABSTRACT

The novel fuel additives contain elements available in seawater and the reaction product of a hydrocarbon oil and a strong alkali, dissolved in an organic solvent solution. The fuel additives are added to fuels directly and are effective for reducing fuel costs and cleaning the exhaust gas of every type of combustion system.

1 Claim, No Drawings

FUEL ADDITIVES

BACKGROUND OF THE INVENTION

1. Field of the Invention

This invention relates to fuel additives for improving thermal efficiency of petroleum fuel such as gasoline or gas oil and reducing the production of pollutive gases upon combustion.

2. Prior Art

In general, as to ignition engine such as automobile engine, the higher the compression ratio is, the higher the thermal efficiency and performance are, and the lower the fuel cost is. When regular gasoline is used, the high compression tends to cause abnormal combustion or knocking, and the thermal efficiency is decreases as a result.

In order to prevent this, gasoline with a high octane number which has an anti-knocking effect is used to raise the compression ratio and improve the thermal efficiency. However, gasolines with high octane number which are produced by mixing various gasoline components in an appropriate ratio are expensive.

Oxidation of gasoline reduces the octane number and resultant high-molecular weight gum increases fuel consumption. Therefore an anti-oxidizing agent ought to be added to commercial gasoline.

On the other hand, as to oil used for gas engines (compression—ignition engines), stability, fluidity and ignitability are the critical properties. Therefore, gas oil with a high octane number is necessary, although it is expensive compared to the ordinary gas oil.

Another drawback is that oxidation of gas oil produces a high-molecular weight gum. If the amount of the high-molecular weight gum produced is high, it blocks the injection nozzle and hence impedes the supply of the fuel.

In order to prevent this, hydrogenation purification has been required.

The present inventor of the invention was inspired by the abundance of elements contained in seawater and the reaction of an alkaline agent in the combustion process, and developed a combustion aid by dissolving a specific alkaline agent into seawater (Jap. Pat. Laid-open Publ. No. 63-225695), and achieved a marvelous success. This combustion aid (liquid) proved to be especially effective when sprayed into the engine and led to the development of a system for adding this combustion aid to the engine (Jap. Pat. Laid-open Publ. No. 63-147938, Jap. Pat. Appl. No. 62-319327)

However, this combustion aid requires modification of the engine and can not be applied to all types of engines. Above all, the above-mentioned system is designed for an engine utilizing the low pressure produced by the piston motion to send mixture of gases to the combustion chamber. When used with a turbo engine, the combustion aid must be supplied with pressure and hence requires a sophisticated system which involves technical difficulties.

SUMMARY OF THE INVENTION

The above-mentioned drawbacks in the prior art have been successfully eliminated by the present invention.

It is, therefore, the object of the present invention is to provide fuel additives for improving thermal efficiency of any kind of liquid fuel such as gasoline or gas oil by adding directly to the fuel.

Another object of the present invention is to provide fuel additives which are applicable to any kind of combustion system, and at the same time, satisfy both the need for cleaning exhaust gas and the need for improving combustion efficiency.

The fuel additives of the present invention are composed of (1) a powder obtained by removing water from an aqueous solution of the reaction product of a hydrocarbon oil and a strong alkali in seawater and (2) a solvent wherein the powder is dissolved which is soluble in the fuel which to the fuel additive is added. The fuel additives can prevent formation of acidic pollutants such as CO, NOx and the like in the combustion system, and at the same time, can achieve complete combustion of the fuel, when admixed with fuel.

These and other objects of the present invention will become apparent from the following description of preferred embodiments.

DETAILED DESCRIPTION OF PREFERRED EMBODIMENTS

The present invention will be described with reference to the examples to follow below but the invention is not deemed to be limited to such examples, the scope of the invention being indicated by the appended claims.

The fuel additive of the present invention is a solution which is soluble in fuel, wherein powder obtained by removing water from the combustion aid developed by the applicant is dissolved. The combustion aid from which water is to be removed is an aqueous solution of the reaction product of a hydrocarbon oil and a strong alkali in seawater.

The reaction product of a hydrocarbon oil and a strong alkali will be described hereinafter.

Petroleum fractions equivalent to or heavier than the fuel, or the like are employed as the hydrocarbon oil and they are not necessarily commercially available petroleum fractions but may alternatively be halogen-containing oils. Further, distillates obtained by fractionation (dry distillation) of vinyl resins such as plastics which are industrial wastes, foamed polystyrene, used tires or the like can be effectively utilized and such a source is preferred from the viewpoint of effective utilization of industrial waste.

As the strong alkali used here preferred are alkali materials containing calcium oxide as a major component. However, again from a practical viewpoint, there can be used alkaline products obtained by sintering shell, bone, limestone or the like at high temperatures of approximately 1000° to 1500° C. The sintered products of shell or the like at high temperatures are strongly alkaline and contain calcium oxide as a major component. When dissolved in water, such sintered materials give a strongly alkaline aqueous solution having a pH of 13. The reaction product (a) is a powdery or clay-like reaction mixture obtained by mixing the hydrocarbon oil with the strong alkali in a ratio of approximately 1:1, adding a small amount of an aqueous solution of the strongly alkaline agent thereto and stirring the mixture. The blending ratio of the hydrocarbon oil and the strong alkali, while normally approximately 1:1, is not limited thereto since the ratio will vary slightly depending upon the type of oil used. The small amount of strong alkali aqueous solution is added to accelerate the reaction of the oil with the dry strong alkali and the alkali used to form that aqueous solution may be the same strong alkali added to the hydrocarbon to form the reaction product (a). Where the dry fractionation oils used in the reaction mixture (a) contain water, it is unnecessary to add water in the preparation of (a).

An aqueous solution is obtained by dissolving the reaction product (a) in seawater. Seawater is used because, firstly, seawater is a infinite resource. Secondly, seawater contains trace amounts of various metal ions and it is believed that such metals catalytically aid combustion. Thirdly, the composition of seawater is relatively constant and can be utilized as is. It is preferred that the pH of seawater be adjusted to strongly acidic or strongly alkaline prior to mixing with the product (a), depending upon the intended use. Before dissolving the reaction product in seawater, the pH of seawater is adjusted to low or high.

In order to make seawater acidic, diluted sulfuric acid (pH 0.1 or less) or a particularly adjusted acid (hereinafter referred to as "P-S acid") as described below is added to seawater. The terminology "P-S acid" as used herein has reference to an aqueous solution obtained by adding about 5% of concentrated sulfuric acid to a strong electrolyte solution containing calcium phosphate and removing precipitates, resulting in a solution having a pH of 0.1 or less. The seawater in which the pH is lowered by addition of the P-S acid provides a good miscibility with the product (a), i.e. the reaction mixture of the hydrocarbon oil and alkali.

P-S acid or diluted sulfuric acid is added to seawater in an amount of about 5% to adjust its pH to 2 or less. The pH-adjusted seawater may be used for dissolving the reaction product. Further, the pH-adjusted seawater wherein the pH has been so lowered may be adjusted to high pH by adding a strongly alkaline agent thereto.

In order to make seawater strongly alkaline, one may use sodium hydroxide, calcium oxide or the same strong alkali as used to form the reaction product (a). By removing insoluble matters or precipitates, an aqueous solution having a pH of 13 or more can be obtained.

The reaction mixture (a) of hydrocarbon oils and a strong alkali is dissolved in the pH adjusted-seawater up to saturation. By removing insoluble matter, an aqueous solution (b) is obtained.

The solid component of the fuel additives of the present invention, powder (1) is obtained by removing water from the aqueous solution (b) by heating and evaporating. This procedure is preferably carried out under low pressure. The result of the elementary analysis of the powder (1) is shown in Table 1.

TABLE 1

| | Powder (1) (wt %) | Fuel (wt %) additives | Seawater (mg/l) |
|---|---|---|---|
| Na | 43.2 | 0.20 | 10.5 |
| K | 0.72 | 0.009 | 0.380 |
| Ca | 0.11 | — | 0.401 |
| Sr | 0.009 | — | 0.008 |
| B | 0.005 | — | 0.0048 |
| Si | — | 0.002 | 0.003 |
| Fe | 0.005 | — | — |
| Br | 0.15 | 0.002 | — |
| Cl | 25 | 0.007 | 18.98 |
| S | 2.4 | 0.023 | 0.90 |

The amount of chloride in the powder (1) is considerably less than that in seawater according to the analysis, and the powder (1) is strongly alkaline.

Then the fuel additive of the present invention is obtained by dissolving the powder (1) in a solvent which is compatible with the intended fuel. The solvent satisfying this condition is preferably the mixture of alcohol and an organic solvent. Kerosene is practical as an organic solvent. The alcohol may be methanol, butanol, mixture of those alcohols or the like.

The ratio of kerosene and alcohol or the like is selected according to fuel with which the addition is to be used. When gasoline or light gas is used for fuel, it is preferable that the solvent of the fuel additive contains at least 10% of butanol therein.

The concentration of the powder (1) in the solvent is about 1%. It is preferred to prepare a stock solution in which several % of the powder (1) is dissolved and then to adjust the concentration and composition of solvent by adding a proper solvent to match with fuel used. The result of the elemental analysis of the stock solution is shown in Table 1.

As described hitherto, the fuel additives of the present invention are applied directly to the fuel, such as gasoline, light gas or heavy oil. The amounts of the fuel additives to be added differ according to the kind of the fuel. Generally, 0.1–0.3% is added in gasoline, 0.3–0.5% in light gas and approximately 1% in heavy oil.

By adding the fuel additives of the present invention to these fuels, the condition of combustion is improved considerably, the fuel cost decreases and the toxic gases such as CO, NOx are suppressed.

EXAMPLE

1. Preparation of P-S acid 50 g of a powder consisting mainly of calcium phosphate obtained by sintering animal bones was dissolved in 1 liter of pure water. Then 5% of conc. sulfuric acid was added to the aqueous solution to give a strongly acidic aqueous solution having a pH of 0.2 (P-S acid).

2. Adjustment of pH of seawater

To 500 liters of seawater was added 10 liters of the P-S acid described above. After allowing to stand for 3 hours, impurities were filtered off. As a result, the seawater had a pH of 1.6. Then, 3% of sodium hydroxide was added thereto. After allowing to stand overnight, precipitates were removed to give seawater having a pH of 13.7.

3. Preparation of a reaction product 500 g of the strong alkali obtained by sintering limestones at high temperatures of approximately 1000° to 1500° C. was added to 500 cc of fractionated oil of used tires and, 100 cc of an aqueous solution of strong alkali was further added to the mixture. After stirring, the mixture was allowed to stand for 30 minutes under about 2 atms. to give a powdery reaction mixture (a).

After stirring 1000 cc of the alkaline seawater and 30 g of the reaction mixture (a) in a reactor under 1.5 atms. at room temperature for about an hour, the mixture was allowed to stand almost overnight. Insoluble matters were removed to give an aqueous solution in the form of a homogeneous liquid.

60 kg of powder (1) was obtained by evaporating one ton of this solution.

On the other hand, the mixed solvents of kerosene and alcohol were made up according to the following prescription, and 1 kg of aforesaid powder (1) was added to each 30 l of mixed solvent and stirred, so that stock solution of the fuel additives were obtained.

| | |
|---|---|
| Prescription A | |
| Methanol | 6 l |
| Butanol | 10 l |
| Kerosene | 14 l |
| Prescription B | |
| Methanol | 8 l |
| Butanol | 12 l |
| Kerosene | 20 l |
| Thinner | 4 l |
| Prescription C | |
| Butanol | 0.5 l |
| Thinner | 4 l |
| Prescription D | |
| Methanol | 5 l |
| Butanol | 12.5 l |

10 liters of these stock solutions of prescription A and D were diluted with a solvent consisting of 20 liters of kerosene and 1.5 liters of butanol to give fuel additives A and D. Fuel additive C was obtained by diluting 2.5 liters of the stock solution of prescription C by a solvent consisting of 15 liters of kerosene and 6.5 liters of butanol.

EXAMPLE 1 AND 2

The fuels were made by adding 120 cc of fuel additives A or D to 60 liters of gasoline and running test of a gasoline car of 2000 cc exhaust were conducted by using these fuels. After running for 15000 km, the amounts of HC and CO in the exhaust gas were analyzed. The results and the fuel efficiency are shown in Table 2, as compared to Comparative example 1 of an automobile for the same type using no additives.

TABLE 2

| | Example 1 | Example 2 | Comparative 1 |
|---|---|---|---|
| CO (%) | 0.1 | 0.01 | 0.3 |
| HC (ppm) | 0.2 | 20 | 180 |
| Fuel (km/l) | 8.35 | 8.80 | 7.35 |

EXAMPLE 3

The fuel was made by adding 180 cc of the fuel additive A to 60 liters of gas oil and running tests of a diesel car were conducted using this fuel. After running for 15000 km, the fuel efficiency was tested and black smoke in the exhaust gas was analyzed. The results are shown in table 3, as compared to Comparative Example 2 for an automobile of the same brand using no additives.

TABLE 3

| | Example 2 | Comparative 2 |
|---|---|---|
| Fuel (km/l) | 11.4 | 9.2 |
| Black smoke | 16% | 22% |

EXAMPLE 4 and 5

The fuel additive C or the stock solution of B was added in an amount 1% to fuels of an oil stove and the stock solution of B in an amount 1% to an oil boiler. The combustion condition was improved as compared with the previous condition using no fuel additives in each case. At the same time, odor and black smoke decreased and less fuel was spent.

Thus, there is provided in accordance with the invention fuel additives which can improve of fuel efficiency and reduction of HC, CO etc. in the waste gas and can be applied to not only internal combustion engines but also to other types of combustion systems such as boiler, stove, etc. The embodiments described above are intended to be merely exemplary and those skilled in the art will be able to make variations and modifications without departing from the spirit and scope of the invention. All such modifications and variations are contemplated as falling within the scope of the claims.

What is claimed is:

1. A fuel additive consisting essentially of an organic solvent and, dissolved in said organic solvent, about 1% of a powder obtained by removing water from an aqueous solution of the reaction product of a hydrocarbon oil and strong alkali in seawater, said organic solvent consisting essentially of kerosene and a $C_1$ $C_4$ alcohol, said solvent containing at least 10% alcohol.

* * * * *

UNITED STATES PATENT AND TRADEMARK OFFICE

CERTIFICATE OF CORRECTION

PATENT NO. : 5,087,267

DATED : February 11, 1992

INVENTOR(S) : Atsushi Nasu

It is certified that error appears in the above-indentified patent and that said Letters Patent is hereby corrected as shown below:

Col. 1, line 17, "decreases" should read --decreased--.

line 13, delete "which to" insert --to which--;

line 32, before "from" insert a comma --,--; and line 33, after "removed" insert a comma --,--.

Col. 3, line 51, delete "elementary" insert --elemental--.

Column 4, line 68, delete "prescription" insert --prescriptions --.

UNITED STATES PATENT AND TRADEMARK OFFICE

CERTIFICATE OF CORRECTION

PATENT NO. : 5,087,267

DATED : February 11, 1992

INVENTOR(S) : Atsushi NASU

It is certified that error appears in the above-indentified patent and that said Letters Patent is hereby corrected as shown below:

Col. 5, line 2, delete "solution" insert --solutions--;

line 31, delete "test" insert --tests--; and

Signed and Sealed this

Twenty-fourth Day of August, 1993

Bruce Lehman

*Attest:*

BRUCE LEHMAN

*Attesting Officer*

*Commissioner of Patents and Trademarks*